US009051714B2

(12) United States Patent
Opdenbosch

(10) Patent No.: US 9,051,714 B2
(45) Date of Patent: Jun. 9, 2015

(54) METERLESS HYDRAULIC SYSTEM HAVING MULTI-ACTUATOR CIRCUIT

(75) Inventor: Patrick Opdenbosch, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 910 days.

(21) Appl. No.: 13/250,067

(22) Filed: Sep. 30, 2011

(65) Prior Publication Data

US 2013/0081704 A1 Apr. 4, 2013

(51) Int. Cl.
*F16D 31/02* (2006.01)
*E02F 9/22* (2006.01)
(Continued)

(52) U.S. Cl.
CPC ..... *E02F 9/2296* (2013.01); *E02F 9/2217* (2013.01); *E02F 9/2235* (2013.01); *E02F 9/2289* (2013.01); *F15B 7/006* (2013.01); *F15B 11/036* (2013.01); *F15B 11/0423* (2013.01); *F15B 15/221* (2013.01); *F15B 2211/20546* (2013.01); *F15B 2211/20561* (2013.01); *F15B 2211/20569* (2013.01); *F15B 2211/212* (2013.01); *F15B 2211/27* (2013.01); *F15B 2211/30565* (2013.01); *F15B 2211/30595* (2013.01); *F15B 2211/31529* (2013.01); *F15B 2211/31541* (2013.01); *F15B 2211/40592* (2013.01); *F15B 2211/41563* (2013.01); *F15B 2211/50527* (2013.01); *F15B 2211/613* (2013.01); *F15B 2211/625* (2013.01); *F15B 2211/6346* (2013.01); *F15B 2211/6654* (2013.01); *F15B 2211/7055* (2013.01); *F15B 2211/7128* (2013.01); *F15B 2211/7135* (2013.01); *F15B 2211/7142* (2013.01); *F15B 2211/761* (2013.01); *F15B 2211/763* (2013.01); *F15B 2211/785* (2013.01); *F15B 2211/88* (2013.01); *E02F 9/2285* (2013.01)

(58) Field of Classification Search
CPC ..... F15B 11/16; F15B 11/17; F15B 13/06; E02F 9/2289; E02F 9/2292; E02F 9/2296
USPC ..... 60/413, 414, 420, 445, 459, 473, 475, 60/476, 484
See application file for complete search history.

(56) References Cited

U.S. PATENT DOCUMENTS 4,369,625 A 1/1983 Izumi et al.
4,449,366 A 5/1984 Sato et al.
(Continued)

FOREIGN PATENT DOCUMENTS

EP 0071228 B1 5/1987
EP 1 598 561 11/2005
(Continued)

OTHER PUBLICATIONS

Zick, J., entitled "Verbesserte Leistungsausnutzung bei Erdbaumaschinen durch optimal Pumpensteuerung", Olhydraulic und pneumatic 20 (1976) Nr. 4.
(Continued)

*Primary Examiner* — Michael Leslie
(74) *Attorney, Agent, or Firm* — Finnegan, Henderson, Farabow, Garrett & Dunner, LLP

(57) ABSTRACT

A hydraulic system is disclosed. The hydraulic system may have a pump, a first actuator, and a meterless circuit connecting the first actuator to the pump. The hydraulic system may also have a second actuator connected to the meterless circuit in parallel with the first actuator. The second actuator may be a variable-area linear actuator.

15 Claims, 3 Drawing Sheets

(51) Int. Cl.

| | |
|---|---|
| ***F15B 11/036*** | (2006.01) |
| ***F15B 11/042*** | (2006.01) |
| *F15B 7/00* | (2006.01) |
| *F15B 15/22* | (2006.01) |

(56) References Cited

U.S. PATENT DOCUMENTS

| | | | | |
|---|---|---|---|---|
| 4,561,249 | A | | 12/1985 | Watanabe et al. |
| 4,586,330 | A | | 5/1986 | Watanabe et al. |
| 4,602,481 | A | * | 7/1986 | Robinson ..... 60/581 |
| 4,768,339 | A | | 9/1988 | Aoyagi et al. |
| 4,833,798 | A | | 5/1989 | Ehrich |
| 4,938,023 | A | | 7/1990 | Yoshino |
| 5,011,180 | A | * | 4/1991 | Dunwoody ..... 280/5.507 |
| 5,048,293 | A | | 9/1991 | Aoyagi |
| 5,329,767 | A | | 7/1994 | Hewett |
| 6,330,797 | B1 | | 12/2001 | Kondo |
| 6,745,992 | B2 | | 6/2004 | Yang et al. |
| 6,789,335 | B1 | | 9/2004 | Kinugawa et al. |
| 6,918,247 | B1 | | 7/2005 | Warner |
| 7,243,591 | B2 | | 7/2007 | Dixen et al. |
| 7,260,931 | B2 | | 8/2007 | Egelja et al. |
| 7,272,928 | B2 | | 9/2007 | Ariga et al. |
| 7,412,827 | B2 | | 8/2008 | Verkuilen |
| 7,434,391 | B2 | | 10/2008 | Asam et al. |
| 7,490,421 | B1 | | 2/2009 | Pletzer et al. |
| 7,516,613 | B2 | | 4/2009 | Kadlicko |
| 7,634,911 | B2 | | 12/2009 | Brinkman |
| 7,827,787 | B2 | | 11/2010 | Cherney et al. |
| 2004/0083629 | A1 | | 5/2004 | Kondou |
| 2004/0123499 | A1 | | 7/2004 | Arii |
| 2005/0012337 | A1 | | 1/2005 | Yoshimatsu |
| 2005/0036894 | A1 | | 2/2005 | Oguri |
| 2007/0044463 | A1 | | 3/2007 | VerKuilen et al. |
| 2008/0250783 | A1 | | 10/2008 | Griswold |
| 2008/0300757 | A1 | | 12/2008 | Kanayama et al. |
| 2008/0314038 | A1 | | 12/2008 | Tozawa et al. |
| 2009/0165450 | A1 | | 7/2009 | Cherney et al. |
| 2009/0288408 | A1 | | 11/2009 | Tozawa et al. |
| 2010/0000209 | A1 | | 1/2010 | Wada et al. |
| 2010/0000211 | A1 | | 1/2010 | Ikeda et al. |
| 2010/0043420 | A1 | | 2/2010 | Ikeda et al. |
| 2010/0107620 | A1 | | 5/2010 | Nelson et al. |
| 2010/0115936 | A1 | | 5/2010 | Williamson et al. |
| 2010/0162593 | A1 | | 7/2010 | Hughes, IV et al. |
| 2010/0162885 | A1 | | 7/2010 | Hughes, IV et al. |
| 2010/0163258 | A1 | | 7/2010 | Hughes, IV et al. |
| 2010/0218493 | A1 | | 9/2010 | Nakamura et al. |
| 2011/0029206 | A1 | | 2/2011 | Kang et al. |
| 2011/0030364 | A1 | | 2/2011 | Persson et al. |

FOREIGN PATENT DOCUMENTS

| | | |
|---|---|---|
| GB | 2 269 425 | 2/1994 |
| JP | 56-016735 | 2/1981 |
| JP | 57-134007 | 8/1982 |
| JP | 58-044133 | 3/1983 |
| JP | 02-108733 | 4/1990 |
| JP | 06-057786 | 3/1994 |
| JP | 10-96402 | 4/1998 |
| JP | 2006-118685 | 5/2006 |
| JP | 2007-247701 | 9/2007 |
| JP | 2011-069432 | 4/2011 |
| WO | WO 2005/024246 | 3/2005 |
| WO | WO 2009/084853 | 7/2009 |
| WO | WO 2009/123047 | 10/2009 |
| WO | WO 2010/040890 | 4/2010 |
| WO | WO 2011/041410 | 4/2011 |

OTHER PUBLICATIONS

Linjama, M. (2011) entitled "Digital Fluid Power-State of the Art", The 12$^{th}$ Scandinavian International Conference on Fluid Power, May 18-20, 2011 Tampere, Finland.

Zimmerman, J. PhD Student/Purdue University, Center for Compact and Efficient Fluid Power PowerPoint Presentation, Annual Meeting (Jun. 14).

Zimmerman, J. et al., "Hybrid Displacement Controlled Multi-Actuator Hydraulic Systems", The Twelfth Scandinavian International Conference on Fluid Power, Tampere, Finland (May 18-20, 2011).

Brezonick, M., entitled "The Potential of Pump-Controlled Hydraulics", Hydraulic Horizons, Diesel Progress North American Edition (Jan. 2009).

Linde Hydraulics Brochure entitled "HPV-02. Variable Pumps for Closed Loop Operation", available at least as early as Aug. 31, 2011, pp. 1-36.

* cited by examiner

METERLESS HYDRAULIC SYSTEM HAVING MULTI-ACTUATOR CIRCUIT

TECHNICAL FIELD

The present disclosure relates generally to a hydraulic system and, more particularly, to a meterless hydraulic system having a multi-actuator circuit.

BACKGROUND

A conventional hydraulic system includes a pump that draws low-pressure fluid from a tank, pressurizes the fluid, and makes the pressurized fluid available to multiple different actuators for use in moving the actuators. In this arrangement, a speed of each actuator can be independently controlled by selectively throttling (i.e., restricting) a flow of the pressurized fluid from the pump into each actuator. For example, to move a particular actuator at a high speed, the flow of fluid from the pump into the actuator is restricted by only a small amount. In contrast, to move the same or another actuator at a low speed, the restriction placed on the flow of fluid is increased. Although adequate for many applications, the use of fluid restriction to control actuator speed can result in flow losses that reduce an overall efficiency of a hydraulic system.

An alternative type of hydraulic system is known as a meterless hydraulic system. A meterless hydraulic system generally includes a pump connected in closed-loop fashion to a single actuator or to a pair of actuators operating in tandem. During operation, the pump draws fluid from one chamber of the actuator(s) and discharges pressurized fluid to an opposing chamber of the same actuator(s). To move the actuator(s) at a higher speed, the pump discharges fluid at a faster rate. To move the actuator with a lower speed, the pump discharges the fluid at a slower rate. A meterless hydraulic system is generally more efficient than a conventional hydraulic system because the speed of the actuator(s) is controlled through pump operation as opposed to fluid restriction. That is, the pump is controlled to only discharge as much fluid as is necessary to move the actuator(s) at a desired speed, and no throttling of a fluid flow is required.

An exemplary meterless hydraulic system is disclosed in U.S. Pat. No. 4,369,625 of Izumi et al. (the '625 patent). In the '625 patent, a multi-actuator meterless-type hydraulic system is described that has flow combining functionality. The hydraulic system includes a swing circuit, a boom circuit, a stick circuit, a bucket circuit, a left travel circuit, and a right travel circuit. Each of the swing, boom, stick, and bucket circuits has a pump connected to a specialized actuator in a closed-loop manner. In addition, a first combining valve is connected between the swing and stick circuits, a second combining valve is connected between the stick and boom circuits, and a third combining valve is connected between the bucket and boom circuits. The left and right travel circuits are connected in parallel to the pumps of the bucket and boom circuits, respectively. In this configuration, any one pump can provide pressurized fluid to multiple different actuators in a closed-loop manner, thereby increasing functionality of the actuators while reducing a number of pumps necessary to drive the actuators.

Although an improvement over existing meterless hydraulic systems, the meterless hydraulic system of the '625 patent may still be less than optimal. In particular, because each actuator of the '625 patent may only be regulated via displacement control of the associated pump, any change in pump operation will simultaneously affect control of all actuators connected to the same pump. Accordingly, the '625 patent may not provide a way to simultaneously move multiple actuators independently.

The hydraulic system of the present disclosure is directed toward solving one or more of the problems set forth above and/or other problems of the prior art.

SUMMARY

In one aspect, the present disclosure is directed to a hydraulic system. The hydraulic system may include a pump, a first actuator, and a meterless circuit connecting the first actuator to the pump. The hydraulic system may also include a second actuator connected to the meterless circuit in parallel with the first actuator. The second actuator may be a variable-area linear actuator.

In another aspect, the present disclosure is directed to a method of operating a hydraulic system. The method may include pressurizing fluid with a pump, directing fluid pressurized by the pump to a first linear actuator and returning fluid from the first linear actuator to the pump via a meterless circuit, and adjusting operation of the pump to adjust operation of the first linear actuator. The method may also include directing fluid pressurized by the pump to a second linear actuator and returning fluid from the second linear actuator to the pump via the meterless circuit, and adjusting a pressure area of the second linear actuator to adjust operation of the second actuator.

DETAILED DESCRIPTION

Figure 1:
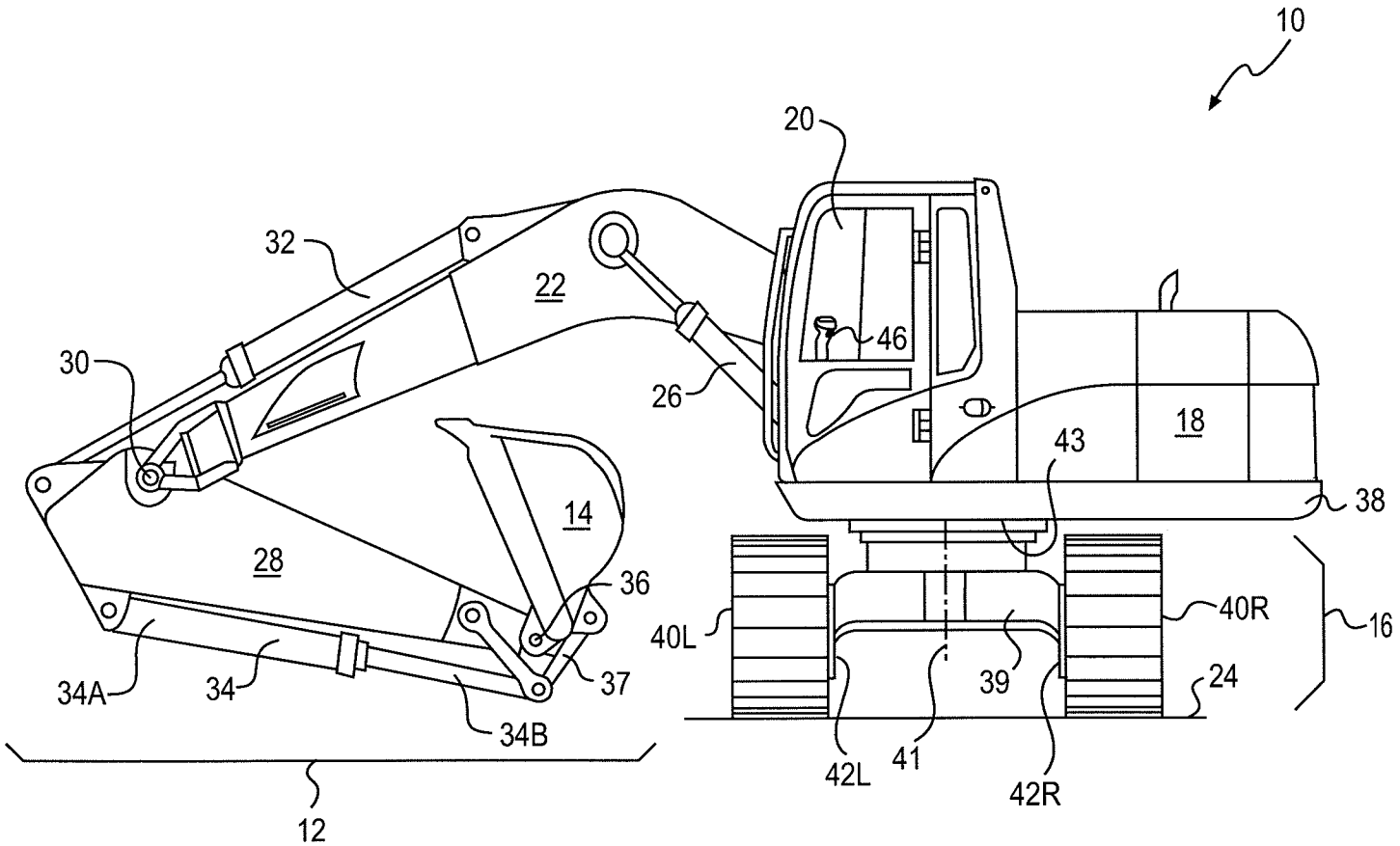
FIG. 1 is a pictorial illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be an earth moving machine such as an excavator (shown in FIG. 1), a dozer, a loader, a backhoe, a motor grader, a dump truck, or another earth moving machine. Machine 10 may include an implement system 12 configured to move a work tool 14, a drive system 16 for propelling machine 10, a power source 18 that provides power to implement system 12 and drive system 16, and an operator station 20 situated for manual control of implement system 12, drive system 16, and/or power source 18.

Implement system 12 may include a linkage structure acted on by linear and rotary fluid actuators to move work tool 14. For example, implement system 12 may include a boom 22 that is vertically pivotal about a horizontal axis (not shown) relative to a work surface 24 by a pair of adjacent, double-acting, hydraulic cylinders 26 (only one shown in FIG. 1). Implement system 12 may also include a stick 28 that is vertically pivotal about a horizontal axis 30 by a single, double-acting, hydraulic cylinder 32. Implement system 12 may further include a single, double-acting, hydraulic cylinder 34 that is operatively connected between stick 28 and work tool 14 to pivot work tool 14 vertically about a horizontal pivot axis 36. In the disclosed embodiment, hydraulic cylinder 34 is connected at a head-end 34A to a portion of stick 28 and at an opposing rod-end 34B to work tool 14 by way of a power link 37. Boom 22 may be pivotally connected to a body 38 of machine 10. Body 38 may be connected to an undercarriage 39 to swing about a vertical axis 41 by a hydraulic swing motor 43. Stick 28 may pivotally connect boom 22 to work tool 14 by way of axes 30 and 36.

Numerous different work tools 14 may be attachable to a single machine 10 and operator controllable. Work tool 14 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although connected in the embodiment of FIG. 1 to pivot in the vertical direction relative to body 38 of machine 10 and to swing in the horizontal direction, work tool 14 may alternatively or additionally rotate relative to stick 28, slide, open and close, or move in any other manner known in the art.

Drive system 16 may include one or more traction devices powered to propel machine 10. In the disclosed example, drive system 16 includes a left track 40L located on one side of machine 10, and a right track 40R located on an opposing side of machine 10. Left track 40L may be driven by a left travel motor 42L, while right track 40R may be driven by a right travel motor 42R. It is contemplated that drive system 16 could alternatively include traction devices other than tracks, such as wheels, belts, or other known traction devices. Machine 10 may be steered by generating a speed and/or rotational direction difference between left and right travel motors 42L, 42R, while straight travel may be facilitated by generating substantially equal output speeds and rotational directions from left and right travel motors 42L, 42R.

Power source 18 may embody an engine such as, for example, a diesel engine, a gasoline engine, a gaseous fuel-powered engine, or another type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic power for moving hydraulic cylinders 26, 32, 34 and left travel, right travel, and swing motors 42L, 42R, 43.

Operator station 20 may include devices that receive input from a machine operator indicative of desired machine maneuvering. Specifically, operator station 20 may include one or more operator interface devices 46, for example a joystick (shown in FIG. 1), a steering wheel, or a pedal, that are located proximate an operator seat (not shown). Operator interface devices 46 may initiate movement of machine 10, for example travel and/or tool movement, by producing displacement signals that are indicative of desired machine maneuvering. As an operator moves interface device 46, the operator may affect a corresponding machine movement in a desired direction, with a desired speed, and/or with a desired force.

Figure 2:
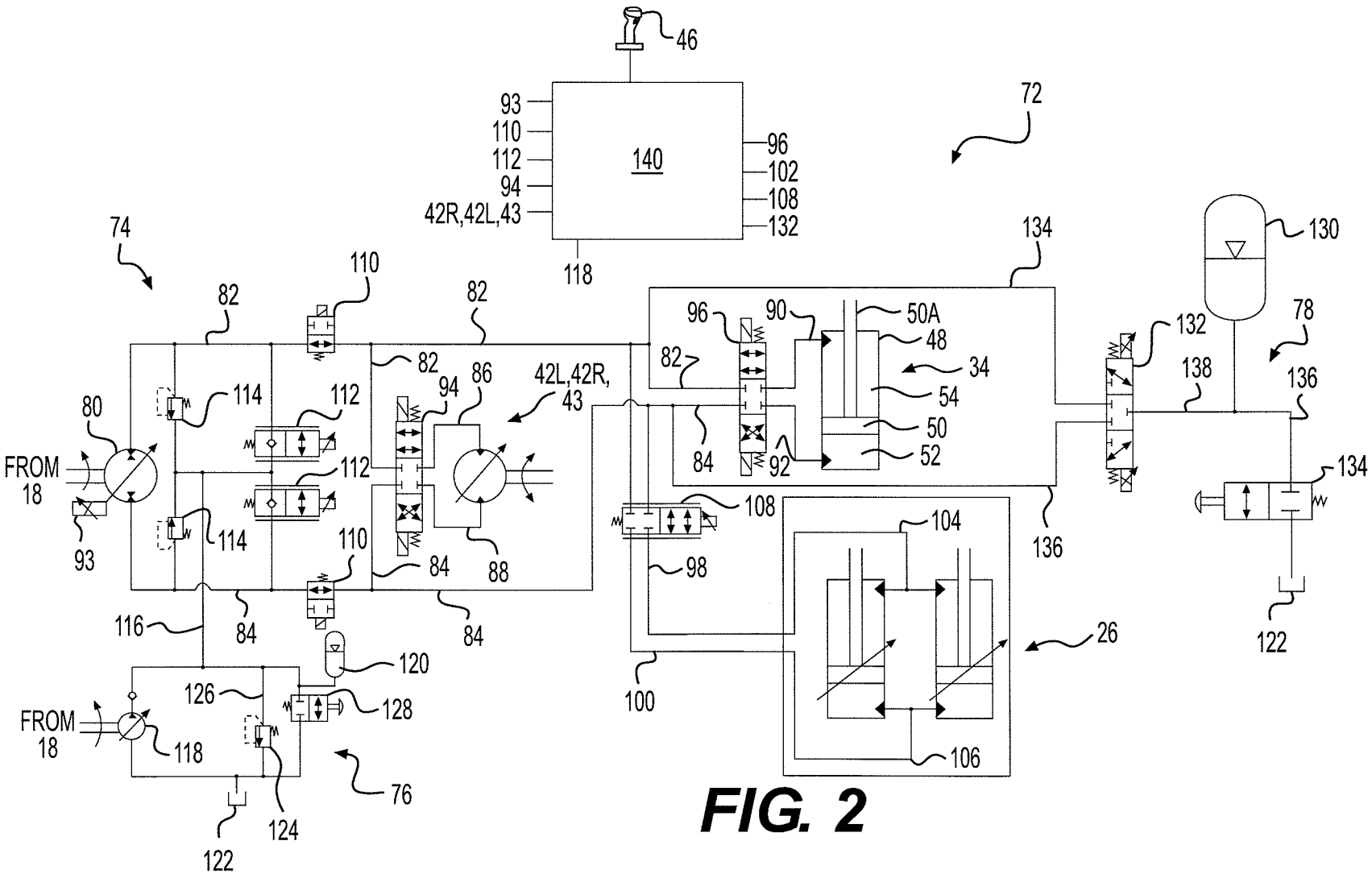
FIG. 2 is a schematic illustration of an exemplary disclosed hydraulic system that may be used in conjunction with the machine of FIG. 1.

As shown in FIG. 2, hydraulic cylinder 34 may include a tube 48 and a piston assembly 50 arranged within tube 48 to form a first chamber 52 and an opposing second chamber 54. In one example, a rod portion 50A of piston assembly 50 may extend through an end of second chamber 54. As such, second chamber 54 may be considered the rod-end chamber of hydraulic cylinder 34, while first chamber 52 may be considered the head-end chamber.

First and second chambers 52, 54 may each be selectively supplied with pressurized fluid and drained of the pressurized fluid to cause piston assembly 50 to displace within tube 48, thereby changing an effective length of hydraulic cylinder 34 and moving work tool 14 relative to stick 28 (referring to FIG. 1). A flow rate of fluid into and out of first and second chambers 52, 54 may relate to a translational velocity of hydraulic cylinder 34, while a pressure differential between first and second chambers 52, 54 may relate to a force imparted by hydraulic cylinder 34 on work tool 14. It should be noted that hydraulic cylinder 34 may be a fixed-area linear actuator, wherein areas exposed to pressurized fluid within first and second chambers 52, 54 of hydraulic cylinder 34 remain fixed throughout operation. Accordingly, for a given pressure differential across piston assembly 50, a force generated by hydraulic cylinder 34 should remain relatively constant.

Although FIG. 2 only illustrates a single rotary actuator, it should be noted that the depicted rotary actuator may represent any one or more of left travel motor 42L, right travel motor 42R, and swing motor 43. Each of left travel motor 42L, right travel motor 42R, and swing motor 43, like hydraulic cylinder 34, may be driven by a fluid pressure differential. Specifically, each rotary actuator may include first and second chambers (not shown) located to either side of a pumping mechanism such as an impeller, plunger, or series of pistons (not shown). When the first chamber is filled with pressurized fluid and the second chamber is drained of fluid, the pumping mechanism may be urged to rotate in a first direction. Conversely, when the first chamber is drained of fluid and the second chamber is filled with pressurized fluid, the pumping mechanism may be urged to rotate in an opposite direction. The flow rate of fluid into and out of the first and second chambers may determine a rotational velocity of the rotary actuator, while a pressure differential across the pumping mechanism may determine an output torque. It is contemplated that a displacement of any one or all of the rotary actuators may be variable, if desired, such that for a given flow rate and/or pressure of supplied fluid, a speed and/or torque output of a particular rotary actuator may be selectively and independently adjusted. In the disclosed embodiment, the rotary actuators are shown as unidirectional actuators, although over-center rotary actuators may also be utilized, if desired.

Figure 3:
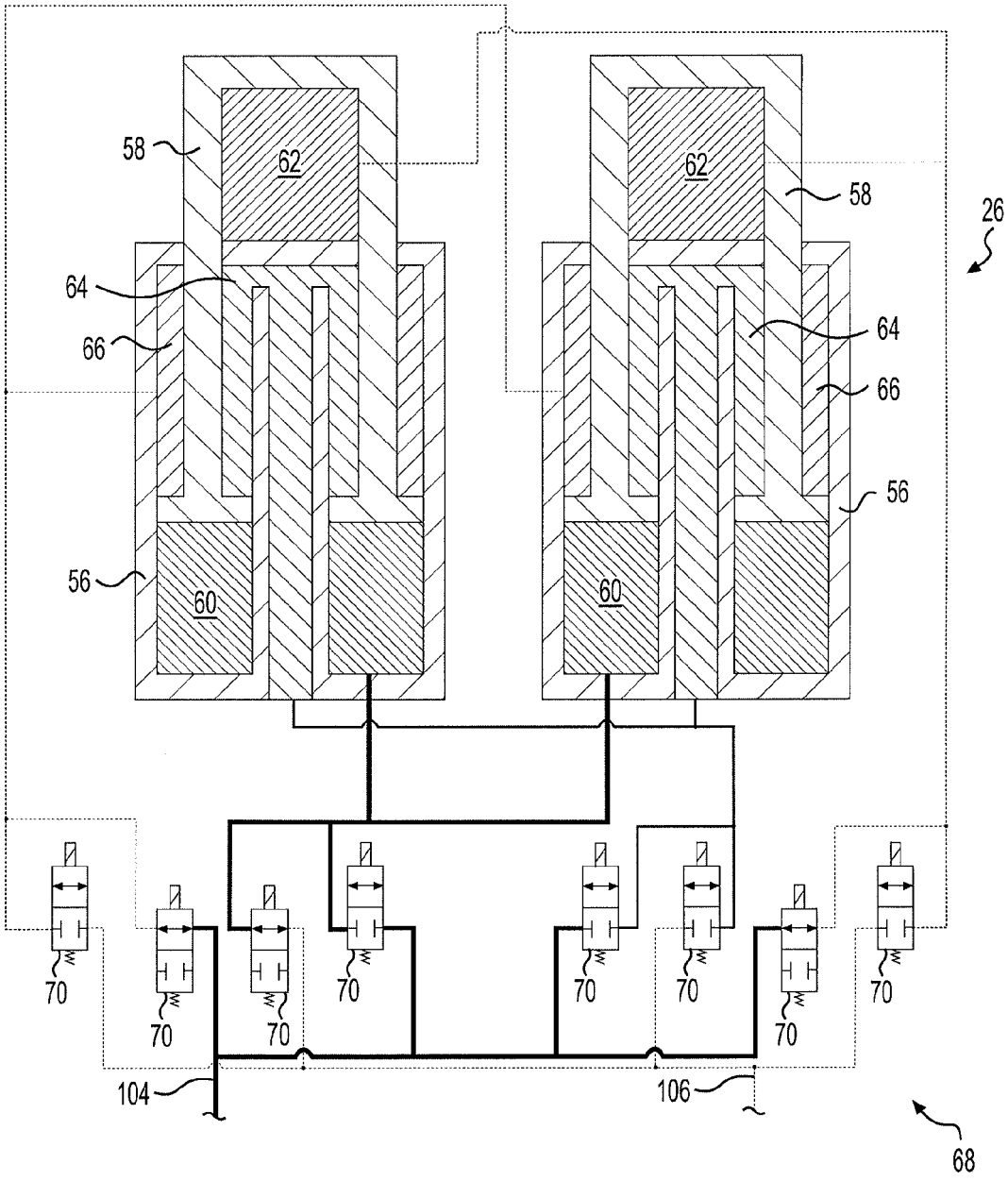
FIG. 3 is a schematic illustration of an exemplary disclosed actuator configuration that may be used in conjunction with the hydraulic system of FIG. 2.

FIG. 2 illustrates only a symbolic representation of hydraulic cylinders 26 at an intended relative location, while FIG. 3 illustrates a detailed exemplary configuration of hydraulic cylinders 26. As shown in FIG. 3, hydraulic cylinders 26 may be variable-area linear actuators. That is, each of hydraulic cylinders 26 may include a greater number of pressure chambers than found in a typical hydraulic cylinder (e.g., more that found in hydraulic cylinder 34 shown in FIG. 2), and each of these chambers may be selectively used to adjust operation of hydraulic cylinder 26. For example, each of hydraulic cylinders 26 depicted in FIG. 3 includes a housing 56 and a piston assembly 58 that divides housing 56 into four different pressure chambers, including a first pressure chamber 60, a second pressure chamber 62, a third pressure chamber 64, and a fourth pressure chamber 66. First and second pressure chambers 60, 62 may each include a pressure area that generates an extending force on hydraulic cylinder 26 when exposed to fluid having an elevated pressure. Similarly, third and fourth pressure chambers 64, 66 may each include a pressure area that generates a retracting force on hydraulic cylinder 26 when exposed to fluid having an elevated pressure. Depending on the pressures of fluid introduced into each of these chambers 60-66, hydraulic cylinders 26 may perform differently. For example, given a high-pressure source and a low-pressure source, pressure chambers 60-66 may each be selectively supplied with fluid at the high-pressure, fluid at the low-pressure, or fluid at a medium-pressure (e.g., a pressure attained by mixing fluid from the high- and low-pressure sources) to generate up to 16 discrete levels of force imparted by hydraulic cylinders 26 on boom 22 (referring to FIG. 1).

As also shown in FIG. 3, hydraulic cylinders 26 may be equipped with a valve arrangement 68 that provides for selective flow control of fluid from the high- and the low-pressure sources into the four pressure chambers 60-66 discussed above. In the disclosed embodiment, valve arrangement 68 includes eight independent on/off-type valves 70 (two valves 70 per pressure chamber, including one for high-pressure control and one for low-pressure control), each valve 70 being configured to move between a fully-open or flow-passing position and a fully-closed or flow-blocking position. Depending on the position of valves 70 paired for a particular one of pressure chambers 60-66, each of pressure chambers 60-66 may be exposed to high-pressure fluid (by fully opening the high-pressure valve), low-pressure fluid (by fully opening the lower pressure valve), or medium-pressure fluid (by simultaneously opening both the low- and high-pressure valves). In addition, each of pressure chambers 60-66 may generate a corresponding force on hydraulic cylinder 26 alone, with, or against another one or more of pressure chambers 60, 66. It is contemplated that valve arrangement 68 may be integrally packaged with hydraulic cylinders 26 or packaged separately and fluidly connected to hydraulic cylinders 26 via external conduits, as desired.

It should be noted that a valve configuration other than arrangement 68 depicted in FIG. 3 may be utilized in conjunction with hydraulic cylinders 26, if desired. For example, an arrangement having one or more spool valves that control simultaneous filling of one or more chambers from both the low- and high-pressure sources or a configuration utilizing variable position valves that meter fluid into and/or out of pressure chambers 60-66 may be utilized. A different valve configuration could result in a greater (e.g., infinite) or lesser number of force levels possible with hydraulic cylinders 26. One skilled in the art will recognize, however, that fluid metering by valve arrangement 68 could reduce the efficiency of hydraulic cylinders 26.

Although not shown, it is contemplated that hydraulic cylinder 32 (referring to FIG. 1) may embody a fixed-area linear actuator similar to hydraulic cylinder 34 shown in FIG. 2, or a variable-area linear actuator similar to hydraulic cylinders 26 shown in FIG. 3. It is also contemplated that other actuators, for example auxiliary actuators, may be utilized within machine 10, and embody rotary actuators similar to left travel, right travel or swing actuators 42L, 42R, 43, or linear actuators similar to hydraulic cylinders 26 or 34, as desired. For purposes of simplicity, hydraulic cylinder 32 is omitted from FIGS. 2 and 3.

Returning to FIG. 2, machine 10 may include a hydraulic system 72 having a plurality of fluid components that cooperate with the linear and rotary actuators described above to move work tool 14 (referring to FIG. 1) and machine 10. In particular, hydraulic system 72 may include, among other things, a meterless circuit 74 in communication with the different actuators of machine 10, a charge circuit 76 in selective fluid communication with meterless circuit 74, and an energy recuperation circuit 78 in selective fluid communication with meterless circuit 74. It is contemplated that hydraulic system 72 may include additional and/or different circuits, if desired.

Meterless circuit 74 may include, among other things, a plurality of interconnecting and cooperating fluid components that facilitate the use and control of the associated actuators. For example, meterless circuit 74 may include a pump 80 fluidly connected to hydraulic cylinder 34 and rotary actuator(s) 42L, 42R, and/or 43 in a parallel, closed-loop manner via upper- and lower-side (relative to FIG. 2) passages. Specifically, pump 80 may be connected to its rotary actuator(s) via a first pump passage 82, a second pump passage 84, and individual actuator passages 86, 88. In addition, pump 80 may be connected to hydraulic cylinder 34 via first and second pump passages 82, 84, a rod-end passage 90, and a head-end passage 92.

Pump 80 may have variable displacement and be controlled to draw fluid from its associated actuators and discharge the fluid at a specified elevated pressure back to the actuators in two different directions (i.e., pump 80 may be an over-center pump). Pump 80 may include a stroke-adjusting mechanism 93, for example a swashplate, a position of which is hydro-mechanically adjusted based on, among other things, a desired speed of the actuators to thereby vary an output (e.g., a discharge rate) of pump 80. The displacement of pump 80 may be adjusted from a zero displacement position at which substantially no fluid is discharged from pump 80, to a maximum displacement position in a first direction at which fluid is discharged from pump 80 at a maximum rate into first pump passage 82. Likewise, the displacement of pump 80 may be adjusted from the zero displacement position to a maximum displacement position in a second direction at which fluid is discharged from pump 80 at a maximum rate into second pump passage 84. Pump 80 may be drivably connected to power source 18 of machine 10 by, for example, a countershaft, a belt, or in another suitable manner. Alternatively, pump 80 may be indirectly connected to power source 18 via a torque converter, a gear box, an electrical circuit, or in any other manner known in the art. It is contemplated that pump 80 may be connected to power source 18 in tandem (e.g., via the same shaft) or in parallel (e.g., via a gear train) with other pumps (not shown) of machine 10, as desired.

Pump 80 may also be selectively operated as a motor. More specifically, when an associated actuator is operating in an overrunning condition (i.e., a condition where the actuator is driven by a load), the fluid discharged from the actuator may have a pressure elevated above an output pressure of pump 80. In this situation, the elevated pressure of the actuator fluid directed back through pump 80 may function to drive pump 80 to rotate with or without assistance from power source 18. Under some circumstances, pump 80 may even be capable of imparting energy to power source 18, thereby improving an efficiency and/or capacity of power source 18.

A first switching valve 94 may be disposed between first and second pump passages 82, 84 and actuator passages 86, 88, while a second switching valve 96 may be disposed between first and second pump passages 82, 84 and rod- and head-end passages 90, 92. In the depicted embodiment, switching valves 94, 96 may be substantially identical, four-way, spool-type valves that are solenoid movable between three distinct position. When in the first position (shown in FIG. 2), all fluid flow through switching valves 94, 96, may be substantially blocked. When in the second position (i.e., the upper position shown in FIG. 2), switching valve 94 may connect first pump passage 82 to first actuator passage 86 and second pump passage 84 to second actuator passage 88, and switching valve 96 may connect first pump passage 82 to rod-end passage 90 and second pump passage 82 to head-end passage 92. When in the third position (i.e., the lower position shown in FIG. 2), switching valve 94 may connect second pump passage 84 to first actuator passage 86 and first pump passage 82 to second actuator passage 88, and switching valve 96 may connect second pump passage 84 to rod-end passage 90 and first pump passage 82 to head-end passage 90. In this manner, a rotational/movement direction of the rotary actuator(s) and of hydraulic cylinder 34 may be switched either by switching an output flow direction of pump 80 and maintaining a current flow-passing position of switching valves 94, 94, or by maintaining the output flow direction of pump 80 and moving switching valves 94, 96 between the second and third positions. The directions of the rotary actuator(s) and hydraulic cylinder 34 may be independently switched, if desired, through the use of only switching valves 94, 96 or via a combination of pump displacement control and switching valve control. While switching valves 94, 96 have been described as three-position, solenoid-operated valves, other types of valves (e.g., multiple independent on/off or metering type valves, valves have more or less than three positions, poppet-type valves, and other valves known in the art) may be utilized to switch fluid flow directions into the rotary actuator(s) and/or hydraulic cylinder 34, if desired. If multiple rotary actuators are to be connected in parallel to meterless circuit 74, each rotary actuator may have its own dedicated switching valve.

Hydraulic cylinders 26 may be connected to meterless circuit 74 in parallel with the rotary actuator(s) and hydraulic cylinder 34. In particular, a first actuator passage 98 and a second actuator passage 100 may extend from first and second pump passages 82, 84, respectively, to rod- and head-end passages 104, 106 that extend to hydraulic cylinder 26 (i.e., to valves 70 shown in FIG. 3). In this configuration, first and second pump passages 82, 84 may embody the low- and high-pressure sources discussed above with respect to FIG. 3, depending on the output flow direction of pump 80.

A combiner valve 108 may be disposed within first and second actuator passages 98, 100 to selective fluidly communicate hydraulic cylinders 26 with meterless circuit 74. In the disclosed embodiment, combiner valve 108 may have a valve element movable to any position between flow-blocking and flow-passing positions to selectively control a rate of fluid flow between meterless circuit 74 and hydraulic cylinders 26. It is contemplated, however, that combiner valve 108 could alternatively embody a two-position (on/off) type of valve, if desired.

During some operations, it may be desirable to selectively isolate a suction or low-pressure side of pump 80 from the rotary actuator(s) and/or hydraulic cylinders 26, 34. For this purpose, meterless circuit 74 may be provided with isolation valves 110 capable of substantially blocking fluid flow from the rotary actuators and hydraulic cylinders 26, 34 back to pump 80. Isolation valves 110, in the disclosed embodiment, may be on/off type valves that are solenoid-actuated toward a flow-blocking position and spring-biased toward a flow-passing position. When isolation valves 110 are in the flow-passing position, fluid may flow substantially unrestricted through meterless circuit 74 back into pump 80. When isolation valves 110 are in the flow-blocking position, fluid may not return back to pump 80 from the rotary actuator(s) or hydraulic cylinders 26, 34.

It will be appreciated by those of skill in the art that the respective rates of hydraulic fluid flow into and out of the various pressure chambers of hydraulic cylinders 26, 34 during extension and retraction may not be equal. For example, because of the location of rod portion 50A within second chamber 54 of hydraulic cylinder 34, piston assembly 50 may have a reduced pressure area within second chamber 54, as compared with a pressure area within first chamber 52. Accordingly, during retraction of hydraulic cylinder 34, more hydraulic fluid may be forced out of first chamber 52 than can be consumed by second chamber 54 and, during extension, more hydraulic fluid may be consumed by first chamber 52 than is forced out of second chamber 54. Similar situations may occur within the different pressure chambers 60-66 of hydraulic cylinders 26. In order to accommodate the excess fluid discharged during retraction and the additional fluid required during extension, meterless circuit 74 may be provided with two makeup valves 112 and two relief valves 114 that connect first and second pump passages 82, 84 to charge circuit 76 via a passage 116.

Makeup valves 112 may each be a variable position valve that is disposed between passage 116 and one of first and second pump passages 82, 84 and configured to selectively allow pressurized fluid from charge circuit 76 to enter first and second pump passages 82, 84. In particular, each of makeup valves 112 may be solenoid-actuated from a first position at which fluid freely flows between passage 116 and the respective first and second pump passage 82, 84, toward a second position at which fluid from passage 116 may flow only into first and second pump passage 82, 84 when a pressure of passage 116 exceeds the pressure of first and second pump passages 82, 84 by a threshold amount. Makeup valves 112 may be spring-biased toward their second positions, and only moved toward their first positions during operations known to have need of positive or negative makeup fluid. Makeup valves 112 may also be used to facilitate fluid regeneration between first and second pump passages 82, 84, by simultaneously moving together at least partway to their first positions.

Relief valves 114 may be provided to allow fluid relief from meterless circuit 74 into charge circuit 76 when a pressure of the fluid exceeds a set threshold of relief valves 114. Relief valves 114 may be set to operate at relatively high pressure levels in order to prevent damage to hydraulic system 72, for example at levels that may only be reached when the linear actuators (e.g., hydraulic cylinders 26, 32, 34) reach an end-of-stroke position and the flow from pump 80 is non-zero, or during a failure condition of hydraulic system 72.

Charge circuit 76 may include at least one hydraulic source fluidly connected to passage 116 described above. In the disclosed embodiment, charge circuit 76 has two sources, including a charge pump 118 and an accumulator 120, which may be fluidly connected to passage 116 in parallel to provide makeup fluid to meterless circuit 74. Charge pump 118 may embody, for example, an engine-driven, variable displacement pump configured to draw fluid from a tank 122, pressurize the fluid, and discharge the fluid into passage 116. Accumulator 120 may embody, for example, a compressed gas, membrane/spring, or bladder type of accumulator configured to accumulate pressurized fluid from and discharge pressurized fluid into passage 116. Excess hydraulic fluid, either from charge pump 118 or from meterless circuit 74 (i.e., from operation of pump 80 and/or the rotary and linear actuators) may be directed into either accumulator 120 or into tank 122 by way of a charge relief valve 124 disposed in a return passage 126. Charge relief valve 124 may be movable from a flow-blocking position toward a flow-passing position as a result of elevated fluid pressures within passages 116, 126. A manual service valve 128 may be associated with accumulator 120 to facilitate draining of accumulator 120 to tank 122 during service of charge circuit 76.

Energy recuperation circuit 78 may include at least one high-pressure accumulator 130 that, depending on system demands, may be selectively connected to meterless circuit 74 via an accumulator valve 132 to either accumulate excess pressurized fluid or to discharge previously accumulated fluid. Accumulator 130 may be fluidly connected to first and second pump passages 82, 84 via accumulator passages 134, 136, respectively, via accumulator valve 132, and via a common passage 138. Accumulator valve 132 may be a two-position (flow-blocking and flow-passing), solenoid-actuated valve that is configured to selectively control fluid flow between meterless circuit 74 and accumulator 130. Accumulator valve 132 may be spring-biased toward the flow-blocking position. A manual service valve 135 may be associated with accumulator 130 to facilitate draining of accumulator 130 to tank 122 via a drain passage 137 during servicing.

During operation of machine 10, the operator of machine 10 may utilize interface device 46 to provide a signal that identifies a desired movement of the various linear and/or rotary actuators to a controller 140. Based upon one or more signals, including the signal from interface device 46 and, for example, signals from various pressure sensors (not shown) and/or position sensors (not shown) located throughout hydraulic system 72, controller 140 may command movement of the different valves and/or displacement changes of the different pumps and motors to advance a particular one or more of the linear and/or rotary actuators to a desired position in a desired manner (i.e., at a desired speed and/or with a desired force).

Controller 140 may embody a single microprocessor or multiple microprocessors that include components for controlling operations of hydraulic system 72 based on input from an operator of machine 10 and based on sensed or other known operational parameters. Numerous commercially available microprocessors can be configured to perform the functions of controller 140. It should be appreciated that controller 140 could readily be embodied in a general machine microprocessor capable of controlling numerous machine functions. Controller 140 may include a memory, a secondary storage device, a processor, and any other components for running an application. Various other circuits may be associated with controller 140 such as power supply circuitry, signal conditioning circuitry, solenoid driver circuitry, and other types of circuitry.

INDUSTRIAL APPLICABILITY

The disclosed hydraulic system may be applicable to any machine where improved hydraulic efficiency and performance are desired. The disclosed hydraulic system may provide for improved efficiency through the use of meterless technology. The disclosed hydraulic system may provide for an efficient, yet controllable, system through the use of a variable-area linear actuator. Operation of hydraulic system 72 will now be described.

During operation of machine 10, an operator located within station 20 may command a particular motion of work tool 14 in a desired direction and at a desired velocity by way of interface device 46. One or more corresponding signals generated by interface device 46 may be provided to controller 140 indicative of the desired motion, along with machine performance information, for example sensor data such a pressure data, position data, speed data, pump or motor displacement data, and other data known in the art.

In response to the signals from interface device 46 and based on the machine performance information, controller 140 may generate control signals directed to stroke adjusting mechanism 93 of pump 80, to the rotary actuator(s), and to valves 94, 96, 108, 110, 112, 132. For example, to drive the rotary actuator(s) at an increasing speed in a first direction, controller 140 may generate a control signal that causes pump 80 of meterless circuit 74 to increase its displacement and discharge fluid into first pump passage 82 at a greater rate, while maintaining one of the second and third positions of first switching valve 94. After fluid from pump 80 passes into and through the rotary actuator(s) via first pump passage 82, the fluid may return to pump 80 via second pump passage 84. To reverse the motion of the rotary actuator(s), the output direction of pump 80 may be reversed. If, during the motion of the rotary actuator(s), the pressure of fluid within either of first or second pump passages 82, 84 becomes excessive (for example during an overrunning condition), fluid may be relieved from the pressurized passage to tank 122 via relief valves 114 and common passage 116. Alternatively or additionally, the pressurized fluid may be directed into accumulator 130 via accumulator passages 134, 136, valve 132, and common passage 138. During charging of accumulator 130, the suction or low-pressure side of pump 80 may be partially or fully blocked from the rotary actuator(s) via isolation valves 110, such that the fluid discharging from the rotary actuator(s) may be forced into accumulator 130 rather than recirculated through meterless circuit 74. In contrast, when the pressure of fluid within either of first or second pump passages 82, 84 becomes too low, fluid from charge circuit 76 may be allowed into meterless circuit 74 via common passage 116 and makeup valves 112.

During the motion of the rotary actuator(s), the operator may simultaneously request movement of hydraulic cylinder 34. For example, the operator may request via interface device 46 that hydraulic cylinder 34 be retracted at an increasing speed. When this occurs, controller 140 may generate a control signal that causes pump 80 to increase its displacement and discharge fluid into first pump passage 82 at a greater rate. In addition, controller 140 may generate a control signal that causes second switching valve 96 to move toward and/or remain in its second position. As fluid from pump 80 passes into second chamber 54 of hydraulic cylinder 34 via first pump and rod-end passages 82, 90, fluid may be discharged from first chamber 52 back to pump 80 via head-end and second pump passages 92, 84.

The motion of hydraulic cylinder 34 may be reversed in two different ways. First, the operation of pump 80 may be reversed, thereby reversing the flows of fluid into and out of hydraulic cylinder 34. Although satisfactory in some situations, this method of reversing cylinder motion may only be possible when first switching valve 94 is moved from the second position to the third position to also simultaneously reverse the rotational direction of the rotary actuator(s) (so as to maintain rotation in a desired constant direction) or when the rotary actuator(s) are already stopped and first switching valve 94 is in the flow-blocking position. Otherwise, the motion of hydraulic cylinder 34 may be reversed by moving second switching valve 96 to the third position. If, during the motion of hydraulic cylinder 34, the pressure of fluid within either of first or second pump passages 82, 84 becomes excessive (for example during an overrunning condition), fluid may be relieved from the pressurized passage to tank 122 via relief valves 114 and common passage 116. Alternatively or additionally, the pressurized fluid may be directed into accumulator 130 via accumulator passages 134, 136, valve 132, and common passage 138. In contrast, when the fluid pressure becomes too low, fluid from charge circuit 76 may be allowed into meterless circuit 74 via common passage 116 and makeup valves 112.

As described above, desired operation of the rotary and linear actuators may drive displacement control of pump 80. When both rotary and linear actuator motion are simultaneously desired, however, directional displacement control of pump 80 may be driven based solely on the desired motion of only one of the linear and rotary actuators (e.g., based on the desired motion of hydraulic cylinder 34), although the displacement magnitude of pump 80 may be based on flow requirements of both the rotary and linear actuators. At this time, in order to cause the rotary actuator(s) to independently move in a desired speed and/or with a desired torque, the displacement of the rotary actuator(s) may be selectively varied.

During the motion of the rotary actuator(s) and/or hydraulic cylinder 34, the operator may simultaneously request movement of hydraulic cylinders 26. For example, the operator may request via interface device 46 that hydraulic cylinders 26 be retracted at an increasing speed and/or with an increasing force. When this occurs, controller 140 may generate a control signal that causes pump 80 to increase its displacement and discharge fluid into first pump passage 82 at a greater rate. In addition, controller 140 may generate a control signal that causes valves 70 (referring to FIG. 3) to communicate the fluid from pump 80 with pressure chambers 64 and/or 66, depending on the desired level of speed and/or force. As fluid from pump 80 passes into pressure chambers 64 and/or 66 of hydraulic cylinders 26 via first pump and rod-end passages 82, 104, fluid may be discharged from pressure chambers 60 and/or 62 back to pump 80 via head-end and second pump passages 106, 84.

The motion of hydraulic cylinders 26 may be reversed in two different ways. First, the operation of pump 80 may be reversed, thereby reversing the flows of fluid into and out of hydraulic cylinders 26. Although satisfactory in some situations, this method of reversing cylinder motion may only be possible when first and second switching valves 94, 96 are moved from the second positions to the third positions (or vice versa) to also simultaneously reverse the rotational directions of the rotary actuator(s) and hydraulic cylinder 34 (so as to maintain rotation and translation in desired constant directions) or when the rotary actuator(s) and hydraulic cylinder 34 are already stopped and first and second switching valves 94, 96 are in the flow-blocking positions. Otherwise, the motion of hydraulic cylinders 26 may be reversed by selectively opening and closing valves 70.

As described above, hydraulic cylinders 26, 34 may discharge more fluid during retracting operations than is consumed, and consume more fluid than is discharged during an extending operation. During these operations, accumulator valve 132 may be selectively opened to allow the excess fluid to enter and fill accumulator 130 (when the excess fluid has a sufficiently high pressure, for example during an overrunning condition) or to exit and replenish meterless circuit 74, thereby providing a neutral balance of fluid entering and exiting pump 80.

Regeneration of fluid may be possible when the pressure of fluid exiting an actuator is elevated above a discharge pressure of pump 80. During this situation, both of makeup valves 112 may be simultaneously moved toward their flow-passing positions. In this configuration, makeup valves 112 may allow some of the fluid exiting the actuators to bypass pump 80 and flow directly back to the actuators. This operation may help to reduce a load on pump 80, while still satisfying operator demands, thereby increasing an efficiency of machine 10. In some embodiments, makeup valves 112 may be held partially closed during regeneration to facilitate some energy dissipation that improves controllability.

In the disclosed embodiment of hydraulic system 72, fluid flows provided by pump 80 may be used by the associated linear and rotary actuators in a substantially unrestricted (i.e., unmetered) manner, such that significant energy is not unnecessarily wasted in the actuation process. Thus, embodiments of the disclosure may provide improved energy usage and conservation. In addition, the meterless operation of hydraulic system 72 may, in some applications, allow for a reduction or even complete elimination of metering valves for controlling fluid flow associated with the linear and rotary actuators. This reduction may result in a less complicated and/or less expensive system.

The disclosed hydraulic system may also provide for a reduction in the number of pumps required to facilitate meterless operation of multiple actuators, while still allowing independent and simultaneous control of the actuators. That is, through the use of switching valves, variable displacement rotary actuators, and a variable-area actuator, multiple different actuators can be simultaneously operated and provided with fluid pressurized by a common pump, while still maintaining independent control over each actuator. This ability may help to reduce the number of pumps required on machine 10, along with the associated complexity and cost.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:

a pump;

a first actuator, wherein the first actuator is a fixed-area linear actuator;

a meterless circuit connecting the first actuator to the pump;

a second actuator connected to the meterless circuit in parallel with the first actuator, the second actuator being a variable-area linear actuator;

a rotary actuator connected to the meterless circuit in parallel with the first and second actuators; and at least a first switching valve associated with the rotary actuator and configured to switch a flow direction of fluid passing through the rotary actuator.

2. The hydraulic system of claim 1, wherein the pump is an over-center, variable-displacement pump.

3. The hydraulic system of claim 1, further including at least a second switching valve associated with the second actuator and configured to switch a flow direction of fluid passing into the second actuator.

4. The hydraulic system of claim 3, further including at least a third switching valve associated with the first actuator and configured to switch a flow direction of fluid passing into the first actuator.

5. The hydraulic system of claim 3, further including a combiner valve disposed between the pump and the second actuator, the combiner valve configured to selectively communicate the pump with the second actuator.

6. The hydraulic system of claim 1, further including at least one isolation valve configured to selectively isolate a suction side of the pump from the meterless circuit.

7. The hydraulic system of claim 6, further including a charge circuit in selective fluid communication with the meterless circuit.

8. The hydraulic system of claim 7, further including:

at least one relief valve disposed between the meterless circuit and the charge circuit; and at least one makeup valve disposed between the charge circuit and the meterless circuit.

9. The hydraulic system of claim 1, further including:

an accumulator; and an accumulator valve configured to selectively communicate the accumulator with the meterless circuit.

10. The hydraulic system of claim 1, wherein the meterless circuit is a closed-loop circuit.

11. A hydraulic system, comprising:

an over-center, variable-displacement pump;

a fixed-area linear actuator;

a meterless circuit connecting the fixed-area linear actuator to the pump, wherein operation of the fixed-area linear actuator is controlled via regulation of the pump;

a variable-area linear actuator connected to the meterless circuit in parallel with the fixed-area linear actuator;

a rotary actuator connected to the meterless circuit in parallel with the first and second actuators; and at least a first switching valve associated with the rotary actuator and configured to switch a flow direction of fluid passing through the rotary actuator.

12. The hydraulic system of claim 11, further including a variable displacement rotary actuator connected to the meterless circuit in parallel with the fixed- and variable area actuators.

13. A method of operating a hydraulic system, comprising:

pressurizing fluid with a pump;

directing fluid pressurized by the pump to a first linear actuator and returning fluid from the first linear actuator to the pump via a meterless circuit;

adjusting operation of the pump to adjust operation of the first linear actuator;

directing fluid pressurized by the pump to a second linear actuator and returning fluid from the second linear actuator to the pump via the meterless circuit;

adjusting a pressure area of the second linear actuator to adjust operation of the second actuator;

at least partially isolating a suction side of the pump from the meterless circuit;

selectively storing fluid discharged from the first or second linear actuators while the suction side of the pump is at least partially isolated from the meterless circuit; and providing makeup fluid to the meterless circuit during the selective storing of fluid.

14. The method of claim 13, further including adjusting a displacement position of the pump to switch a movement direction of the first linear actuator.

15. The method of claim 13, further including directing fluid pressurized by the pump to a rotary actuator and returning fluid from the rotary actuator to the pump via the meterless circuit.

* * * * *